US005822223A

United States Patent [19]

Genest

[11] Patent Number: 5,822,223

[45] Date of Patent: Oct. 13, 1998

[54] ELECTRONIC FOOT MEASURING APPARATUS

[75] Inventor: Leonard J. Genest, Santa Ana, Calif.

[73] Assignee: Genovation Inc., Irvine, Calif.

[21] Appl. No.: 906,562

[22] Filed: Aug. 5, 1997

[51] Int. Cl.[6] ..... G01B 7/00

[52] U.S. Cl. ..... 364/560; 364/749

[58] Field of Search ..... 364/556, 560–564, 364/749, 403; 33/3 A, 3 R; 382/22, 60; 356/372, 376; 264/321, 322, 40.1

[56] References Cited

U.S. PATENT DOCUMENTS

| | | | |
|---|---|---|---|
| 5,539,677 | 7/1996 | Smith | 364/560 |
| 5,671,055 | 9/1997 | Whittlesey et al. | 356/376 |
| 5,714,098 | 2/1998 | Potter | 264/40.1 |

OTHER PUBLICATIONS

Instructions for Operating the Brannock Device Scientic Foot Measuring Device. Brannock Company 1960.

*Primary Examiner*—James P. Trammell
*Assistant Examiner*—Kamini S. Shah

[57] ABSTRACT

An apparatus for measuring foot sizes for fitting shoes uses mechanical sliders for sizing the foot disposed in the apparatus using microprocessor controlled electronic sensing of slider positions and computation for display presentation of the foot size so that the operator is presented the length and width of the measured foot without having to interpret conversion charts or printed scales. The operator simply positions a foot on the apparatus with the heel of the foot firmly against a heel cup back stop, then positions the sliders, and activates the apparatus. A toe slider is aligned with the extremity of the longest toe. A ball slider is aligned with the ball of the foot. A width slider is adjusted to contact the side of the foot. The microprocessor senses the slider positions and computes the length and width based on slider positions. Selector switches enable choosing a appropriate scale based upon the appropriate country shoe size standard and upon a man, woman or child shoe size scale.

15 Claims, 2 Drawing Sheets

ELECTRONIC FOOT MEASURING APPARATUS

FIELD OF INVENTION

The present invention relates apparatus for measuring the size of foot of a human being.

BACKGROUND OF THE INVENTION

The well know Brannock device is typically found in most shoe stores around the world for measuring the feet of shoe customers. The Brannock device is a metal foot measuring device that has sliders with scales printed on either the sliders or the platform on which a customer places the foot being measured. The sliders are positioned to determine the length and width of the foot. Readings of the scale positions of the sliders are taken by the operator indicating the length and width of the foot for the purpose of determining shoe size, so that the correct size shoes can be selected for the customer. The Brannock device has remained unchanged for over seventy years. While it has become the standard in the industry for measuring feet, it is difficult to use and cannot be accurately used by many people in the shoe sales industry. However, it has established the fundamental measurement parameters used by shoe manufactures around the world.

The Brannock device has printed scales and sliders, including a right toe scale, a left toe scale, a ball scale for use with a ball slider and a width scale for use with a width slider. Heel cups respectively secure one of the feet in a stable position during measurement. The toe and ball scales are for measuring the length of the foot whereas the width scale is for measuring the width of the foot. The length of the foot is determined by two measurements, a toe length measurement using a toe scale, and a ball length measurement using the ball slider and ball scale. The ball length measurement is also known as the arch length measurement.

The right toe scale is printed on the platform base of the device between the ball slider and the width slider and extends vertically from the center of the device towards the left heel cup, for measuring the toe length of the right foot from the back of the right foot heel to the longest toe. The right foot heel is placed into the back edge heel cup of the device for securing the right foot in a stable position while measuring the right foot. The toe length of the foot is taken by looking straight down over the right foot to identify the printed scale increment covered by the front most extremity of the furthest extending toe.

The ball scale is also printed on the platform base of the device juxtapose the ball slider and extending vertically along the right edge of the device. The ball scale is used for measuring the ball length of the foot using the ball slider. The ball slider is vertically slid along the vertically extending guide to position the ball slider against the ball of the foot on the metatarsal side of the ball joint where it meets the phalange. The ball slider includes a ball socket curved surface for receiving the ball of the foot. The ball slider buttresses the ball of the foot and points to ball scale increments on the ball scale which is normalized to also read in the same units for length of the foot for standard size feet. The measured toe length is typical equal and the measured ball length for a typically shaped foot. Thus, a standard foot of a size of nine reading on the toe scale would likewise read a size of nine on the ball scale. In normal use, the foot length size is determined to be the larger of the toe length from the toe scale reading or the ball length from the ball scale reading in instances where the two readings differ.

The width slider is horizontally slid along a horizontally extending guide to position the width slider to contact the side edge of the foot on one side while the ball slider secures the foot on the other side. The width scale is also printed on the base of the device. The width slider has a foot length scale for reference to the longest length of foot reading. The foot length scale is printed on the width slider with the same numbers as the length of the foot. On the stationary base of the device, the width scale is printed with width sizes, such as, 4A to EEE for use in the United States. The operator then visually references the foot width on the width scale that corresponds with the foot length marking of the foot length scale on the width slider indicating the longest measured length of the foot. The operator then reads the width size on the width scale printed on the stationary platform base of the Brannock device for the determining width size.

The Brannock device is universally configured to measure both feet. The ball and width sliders are used for both right and left foot measurements. The left toe scale is also printed on the base of the device, between the ball slider and the width slider and extends vertically from the center of the device towards the right heel cup, for measuring the length of the left foot from the back of the left foot heel to the longest extending toe. The left foot length is measured using the left toe scale with the left foot heel positioned left heel cup. A left foot heel cup opposes the right foot heel cup. After measuring the right foot, the device is simply rotated and the left foot inserted into the left heel cup. The measurement procedure for the left foot is the same as the measurement procedure for the right foot.

The Brannock device operators do not have a problem with the process of positioning the ball and width sliders during measurements of either foot. These sliders are simple mechanical movements and are easily mastered by the operators. The problem for the operators is the judgments that must be made to interpret the readings on the incremented toe, width and ball scales. Some operators have difficultly making judgments preventing repeatable and accurate foot size measurements. In addition, since the scales are printed on the Brannock device, the scales are marked for only one country shoe size standard, limiting its use or requiring shoe size conversions. Further more, shoe sizes are typically different for men, women and children, types of humans, and separate scales and or conversion tables and charts are needed. This disadvantageously requires conversion tables and charts to be used by the operator to ascertain the shoe size in other country numerical equivalents, or for different type of humans. This further complicates the use of the Brannock device.

SUMMARY OF THE INVENTION

An object of the invention is to employ electronic microprocessor technology to provide a simple to use apparatus to measure the size of a human foot accurately and reliably.

Another object of the invention is to maintain compatibility with the Brannock device foot sizes by presenting similar foot sizes on the visual electronic displays.

Yet another object of the invention is to provide an apparatus for measuring the size of a human foot by slider operation familiar to users of Brannock devices.

Yet another object of the invention is to provide an apparatus for measuring the size of a human foot by slider operation sensed by embedded microprocessor technology which reliably senses the position of the sliders and computes the length and width of the foot.

Yet another object of the invention is to provide an apparatus for measuring the size of a human foot by slider operation sensed by embedded microprocessor technology which senses the position of the sliders and computes the length and width of the foot in values of a selected country shoe size standard and or human type.

Still another object of the invention is a foot size measuring apparatus that provides the measured foot sizes in one of a plurality of country shoe size standards which are selectable by the operator of the apparatus.

Still another object of the invention is to provide a vertically aligned sensing means for sensing the measuring positions of vertically aligned toe slider and ball slider.

Still a further object of the invention is to provide a sensing means for sensing the measuring positions of aligned sliders providing capacitive coupling for the sensing means to sense the position of the sliders.

The invention is an apparatus for measuring the size of human feet for the purpose of determining the proper shoe size. The invention is directed to an apparatus using mechanical sliders electronically interfaced to an electronic slider position sensing and detection means connected to a microcontroller which computes and displays the actual length and width of the foot based on the sliders position. Digital type displays are used for displaying for length and width measurements. In the preferred form, the apparatus comprises a left toe slider, a right toe slider, a ball slider, and a width slider. The ball and width sliders corresponding to the ball and width sliders of the Brannock device. Similar to the Brannock device, the apparatus preferably comprises opposing right and left heel cups for respectively receiving and positioning the right and left foot during respective right and left foot measurements, and comprises opposing ball slider and width slider respectively having a curved ball socket surface and a flat side surface between which is disposed the foot during measurement. However, differing from the Brannock device, the right toe slider and left toe slider are used for measuring the toe length of the respective right foot and left foot. The toe sliders slide vertically juxtaposed and along the length of the foot in a range suitable for pointing too the further tip of the front most extremity of the further extending toe of the foot for measuring the toe length of the foot. As such, sliders positions are sensed by microprocessor technology and foot sizes are computed and displayed without operator interpretations of scale readings. The computation of the foot size is preferably based upon a selected country shoe size standard, and human type, which are preferably switch selectable. Printed toe, ball and width scales are not necessary for operator measurement of the foot size.

Similar to the Brannock device, a foot, such as the right foot, in inserted into one of the respective heel cup, such as the right heel cup. The toe slider is vertically slide, up and down, to a point pointing to the front most extremity at the tip of the further extending toe of the foot for measuring the toe length of the foot. The ball slider is slide vertically, up and down, to a point pointing to the ball of the foot, similar to the operation of the Brannock device. Preferably, the ball slider has a ball socket curved surface for receiving the ball of the foot. The width slider is slid horizontally, left and right, to buttress the side of the foot, similar to the Brannock device.

After the sliders are in position, the apparatus senses the positions of the sliders and then computes and displays the foot size. Start buttons are preferably provided to activate the sensing and computation. Once the sliders are in position, one of the preferred start buttons is pressed which in turn invokes an embedded microcontroller to detect the measuring positions of the sliders. The microprocessor then computes the length and width of the foot preferably using a standard foot size table for the selected country and human type and presents the length and the width in respective digital displays. The apparatus maintains the use of the sliders as well known, but instead of requiring any interpretation by the operator, the embedded microprocessor technology senses the position of the sliders and computes the length and width of the foot and displays the values in the appropriate country shoe size standard and human type. Preferably, the country shoe size standard and human type are selected by selector switches.

A feature of the invention is the electronic sensing of the slider position. Preferably, capacitive coupling is used for sensing the position of the sliders. To make a reliable system that can be used under adverse conditions, such as dirt, moisture, temperature and wear, the slider positions are preferably sensed using a capacitive coupling slider. In the preferred form, each slider contains a capacitive element for coupling a sensing signal. Each capacitive element in the sliders slides along a guide disposed over a row of a plurality of coupling fingers for coupling the sensing signal onto one of the coupling fingers. The microprocessor is programmed to scan the row coupling fingers of the sensing means by selecting the fingers in order and detecting the presence of a coupled sensing signal. When a capacitive element couples the sensing signal to one of the fingers, an address used to select the finger during scanning indicates the position of the finger along the row of fingers to thereby indicate the slider measuring position, to thereby determine the relative position of the slider over the row of fingers. The capacitive coupling sensing has advantages of long term reliability, but other slider position electronic sensing techniques could also be used.

In a preferred form of the invention, the left toe slider, the right toe slider and ball slider, all slide along a common vertically extending guide disposed over a vertical row of coupling fingers extending along the vertical length of the apparatus and along the ball side of the foot. The microprocessor scans the coupling fingers to determine the position of the right toe slider, left toe slider, and ball slider. This vertical alignment minimizes circuit complexity, well suited for multiplexer scanning while providing a reliable capacitive coupling sensing in a common sensing means. These and other advantages of the present invention will become more apparent from the following detailed description of the preferred embodiments.

DETAILED DESCRIPTION OF THE PREFERRED EMBODIMENT

Figure 1:
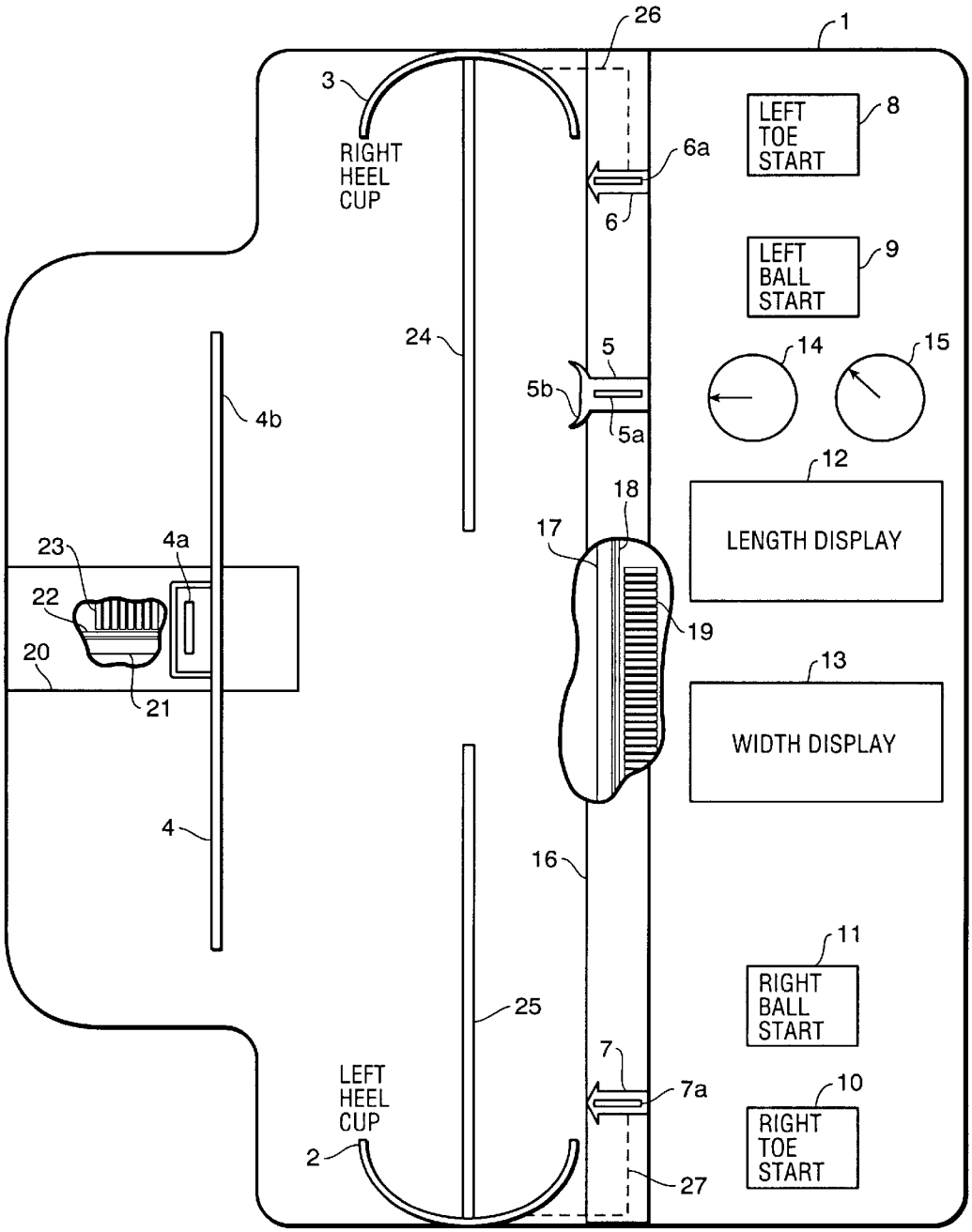
FIG. 1 is a top view of the electronic foot measuring apparatus.

The present invention is described with reference to designations in the drawings. Referring to FIG. 1, an electronic foot measuring apparatus 1 is shown and is used for measuring the foot size of a human. The apparatus 1 preferably includes a left heel cup 2 and a right heel cup 3 and for respectively receiving the right foot heel or the left foot heel, depending on which foot is being measured. For measuring the left foot, the left heel is placed in left heel cup 2. For measuring the right foot, the right heel is placed in right heel cup 3. The orientation of the apparatus 1 is shown for measuring the left foot to be inserted into the left heel cup 2 typically positioned on the floor in front of the human. When changing from left to right, or right to left foot measurements, the apparatus 1 is simply rotated in front of the human to the proper foot orientation.

The apparatus 1 preferably includes a width slider 4, a ball slider 5 and left toe slider 6 and a right toe slider 7 respectively preferably comprising a width slider capacitive element 4*a*, a ball slider capacitive element 5*a*, a left toe slider capacitive element 6*a* and a right toe slider capacitive element 7*a*. The ball slider 5 preferably includes a ball socket 5*b* for receiving the ball at the ball side of the foot to be measured. The width slider 4 preferably includes a flat surface 4*b* for buttresses a width side of the foot and opposes a ball socket 5*b* or the ball slider 5. The sliders 4–7 are slidably positioned to appropriate slider measuring position to measure the foot size.

The apparatus 1 provides the operator with convenient user controls for operation, for measuring the length and width of foot being measured. The apparatus 1 preferably includes a left toe start button 8, a left ball start button 9, a right toe start button 10, a right ball start button 11, a length display 12, a width display 13, a human type select rotary switch 14 and a country shoe size standard select rotary switch 15. The human type select rotary switch 14 selects either options of man, woman or child depending on the type of human having a foot being measured. The country shoe size standard select rotary switch 15 selects the county shoe size standard.

When one of the start buttons 8–11 is depressed the apparatus senses the position of the sliders 4–7 and computes and display the foot length and width. The foot length can be computed using two different methods. When either of the left and right toe start buttons 8 or 10 is depressed, the apparatus 1 is activated to determine the foot length by the first method. The first method is selection of the larger of either the toe length measurement by sensing the measuring position toe sliders 6 or 7, respectively, or a ball length measurement by sensing the position of the ball slider 5. When either of the left or right ball start buttons 9 and 11 is depressed, the apparatus 1 is activated to determine the foot length by the second method. The second is the simply the ball length measurement by sensing the measuring position of the ball slider 5, while ignoring the position of the toe sliders 6 or 7.

To operate the apparatus 1, the operator selects the human type using switch 14, selects the country shoes size standard using switch 15, moves sliders 5–7 to foot measuring positions, presses the start buttons 8–11, and reads the displays 12–13. Typically, a left or right foot is inserted into the corresponding left or right heel cup 2 or 3, and then the sliders 4–7 are slid to the correct measuring positions along the guides 16 and 20, and then one of start switches 8–11 is pressed to take a foot measurement. Only one of the toe sliders 6 or 7 is used during the measurement of a respectively foot.

The toe and ball sliders 5–7 are preferably vertically aligned to and slide, up and down, along a vertically extending vertical guide 16. The sliders 5–7 are vertically slid along vertical guide to the correct measuring positions. The apparatus 1 senses the toe and ball measuring positions of the sliders 5–7 using a sensing means comprising an oscillator rail 17 conducting a sensing signal, a ground line 18 and a row of coupling fingers 19 all disposed and aligned under the guide 16. The capacitive elements 5*a*, 6*a* and 7*a* are used to couple the sensing signal from a sensing rail 17 over the ground line 18 to one of the fingers 19 corresponding to the measuring position of the respective slider 5, 6 or 7. Likewise, the width slider 4 is preferably horizontally aligned to and slides, left and right, along a horizontally extending width guide 20. The apparatus 1 senses the width measuring position of the slider 4 using another sensing rail 21, conducting the sensing signal, another ground line 22 and another row of coupling fingers 23 all disposed and aligned under the width guide 20. The capacitive element 4*a* is used to couple the sensing signal from the sensing rail 21 over the ground line 18 to one of the fingers 23 corresponding to the measuring position of the width slider 4.

When measuring either foot, the ball slider 5 and width slider 4 are slide to respective measuring positions. The ball slider 5 is slid along the guide 16 to the ball measuring position at the ball of the foot, which is where the large toe metatarsal joint meets the phalange, and is received into the ball socket 5*b*. The ball slider 5 is positioned to point to the ball joint of the foot. The width slider 4 is slid along guide 20 to buttress up the width surface 4*b* against the other width side of the foot opposing the ball side of the foot.

When measuring the left toe length, the left toe slider 6 is slid along the guide 16 to the left toe slider measuring position where the left toe slider 6 points to the tip of the further extremity of the further extending toe of the left foot. When measuring the right toe length, the right toe slider 7 is slid along the guide 16 to the right toe slider measuring position where the right toe slider 7 points to the tip of the further extremity of the further extending toe of the right foot. However, this requires the operator to eye-ball the slider 6 or 7 relative the to tip of the further extending toe of the left or right foot, respectively.

In an optional configuration, the apparatus 1 may be modified to preclude the need to eye-ball the toe slider measuring positions. The apparatus may comprise a right heel cup track 24 and a left heel cup track 25 which are used for guiding the respective heel cups 2 and 3, vertically, up and down, from their home positions, as shown, to a toe length measuring position along the tracks 24 and 25. The cups 3 and 4 may be rigidly attached to respective sliders 6 and 7 using a connection means 26 or 27, respectively, so that, as the heel cups 2 or 3 are slid along tracks 24 or 25, sliders 6 and 7 correspondingly slides along the guide 16. During toe length measurement, a left or right foot is firstly inserted into the corresponding left or right heel cup 2 or 3 in the home position, as shown, with its respective toe slider 6 or 7 also in a corresponding home position, as shown, and then, the opposing right or left heel cup 3 or 2, respectively, is slid along the cup track 24 or 25, until the opposing right or left heel cup 3 or 2, respectively, buttresses the tip of the further extending toe of the foot being measured, so as to then position the toe slider 6 or 7 at the correct toe measuring position. For example, a left foot is inserted into the left heel cup 2 in the home position which then places the right toe slider 7 also at the home position, then, the right heel cup 3 is slid from the home position, as shown, along track 24 until buttressing the tip of the further extending toe as the left toe slider 6 slides along guide 16 to the correct left toe measuring position. In this manner, the operator need not eye-ball the toe length measuring position. This optional configuration has the advantage that all of the sliders 4–7 slid to the correct measuring position when a respective slider surface buttressed against the human foot at the correct location, without the need for human eye-ball measurements and interpretations.

Figure 2:
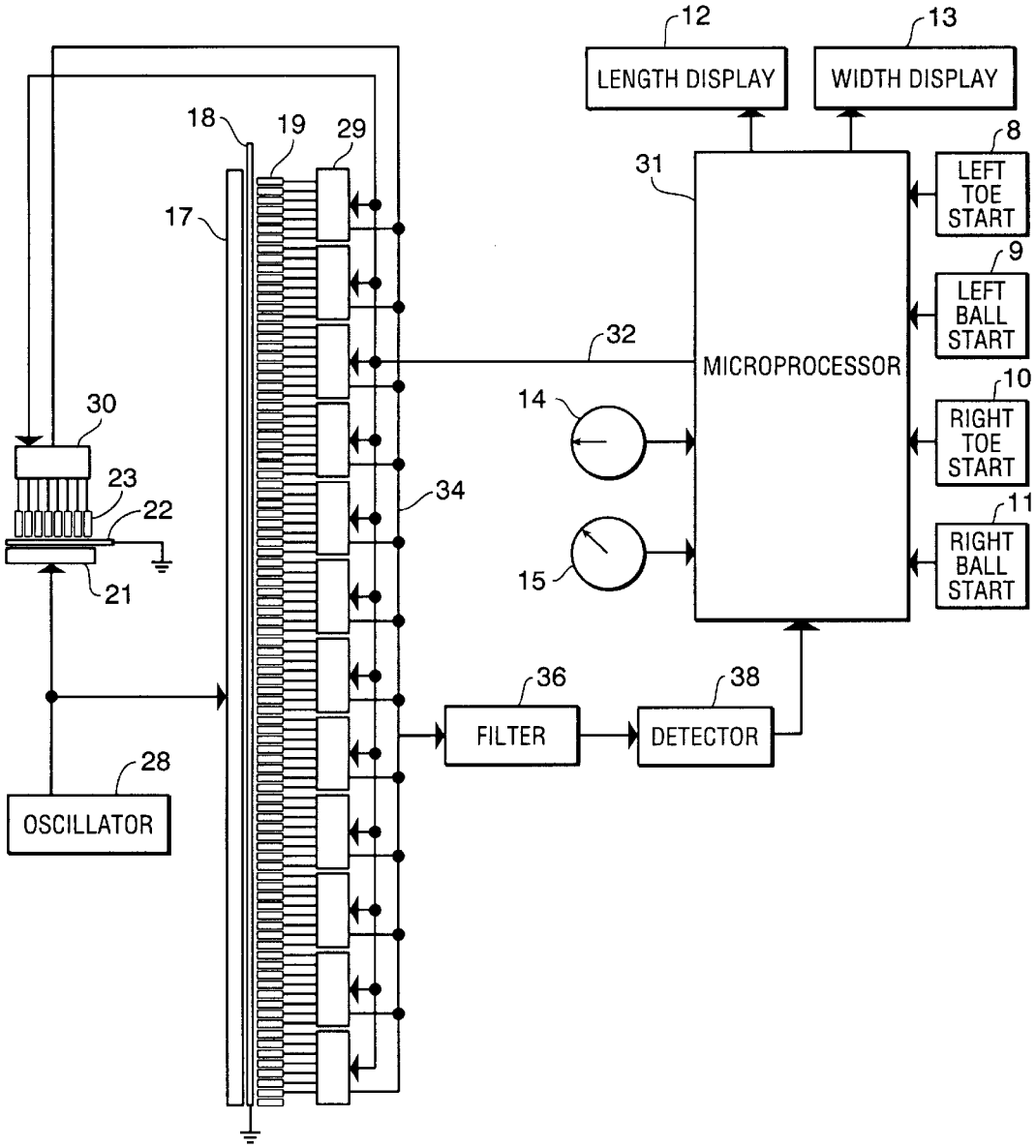
FIG. 2 is a diagram of the electronics components for capacitive coupling measurements.

Referring to FIGS. 1 and 2, the embedded microprocessor technology preferably comprises an oscillator 28 providing the sensing signal to the rails 17 and 21. The sensing signal is coupled from rails 17 and 21, over ground lines 19 and 22, to fingers 19 and 23 and into multiplexers 29 and 30, respectively. The number of width multiplexers 29 and 30 and fingers 19 and 23 may vary, but the length of row of fingers 19 and 23 corresponds to possible lengths and widths of a human foot. For example, but in the exemplar form, there are twelve length multiplexer 29, only one of which is designated as such for clarity, and there is only one width multiplexer 30, as shown.

The position of each sliders 4–7 is preferably determined by the capacitive coupling between the rails 17 or 21 and one of the capacitive fingers 19 or 23, respectively. The sensing signal may be a 15 KHz sine wave oscillating signal that should be filtered for reduced electromagnetic radiation. Between the rails 17 and 21, and the capacitive fingers 19 and 23, are the narrow ground shield lines 18 and 22 which isolate the sensing signal on the rails 17 and 21 from the capacitive fingers 19 and 23. The sliders 4–7 have respective capacitive elements 4*a*–7*a* that extends from the rails 17 and 21 to cover the capacitive fingers 19 and 23. The capacitive elements 4*a*–7*a* is conducting metal having a width that is approximately the width of one capacitive fingers 19 or 23, so that, each element 4*a*–7*a* couples the sensing signal onto a respective particular fingers 19 and 23 corresponding to the respective measuring positions. The particular capacitive fingers 19 or 23 and rails 17 and 21 is spanned by the sliders elements 4*a*–7*a* providing the capacitive coupling between the rails 17 and 21 and the particular capacitance fingers 19 or 23 so that the sensing signal is capacitively coupled to the particular finger 19 and 23. The capacitive fingers 19 and 23 are preferably arranged in a row aligned parallel to the ground lines 15 and the rails 17 and 21. The sliders elements 4*a*–7*a* function as a capacitive coupling bridge from the rails 17 and 21, over the ground lines 18 and 22, to the particular capacitive finger 19 and 23 conducting the sensing signal when positioning sliders 4–7 to respective measuring positions.

The microprocessor technology scans the row of fingers 19 and 23 to determine the measuring positions of the sliders 4–7. Multiplexers 29 and 30 are used to scan the fingers 19 and 23. The Multiplexers may be CD4051 multiplexer chips and are used to scan the fingers by sequentially sampling output levels of each capacitive fingers 19 and 23 in turn and under control of a microprocessor 31 using control lines 32. Each multiplexer 29 or 30 can sample eight capacitive fingers 19 and 23 when appropriately addressed by the microprocessor 31. The outputs of all the multiplexers 29 and 30 are connected together on sense line 34 conducting the sensing signal when a selected finger 19 or 23 has a respective coupling element 4*a*–7*a* positioned over the finger. The sense line is fed into a filter 36 and then into a detector 38 providing a detection signal to the microprocessor 31. The filter 36 may be a band pass amplifier tuned to the frequency of oscillator 28 to filter unwanted signals and noise on the sense line 34. The microprocessor 31 is connected over control lines 32 to control each of the multiplexers 29 and 30 to select respective connected fingers 19 and 23. The microprocessor 31 selects only one capacitive finger 19 or 23 at a time by controlling multiplexers 29 or 30, so that, only one corresponding finger is selected for conducting the sensing signal to the multiplexer output. The sensing signal, if present, from only one finger selected by a respective multiplexer, is conducted to the filter 36. The plurality of multiplexer 29 and 30 function together under control of the microprocessor 31 to scan the fingers 19 and 23 by sequential sampling. In this manner, the microprocessor 31 scans all of the fingers 19 and 23 while sampling the detection signals for the presence of the sensing signals indicating the measuring positions of the sliders 4–7.

The filter 36 provides a filtered signal to the detector 38 which rectifies the filtered signal into a voltage level which is referenced against a reference voltage. If the voltage level of the rectified filtered signal is above the reference voltage, this indicates that one of sliders 4–7 is positioned over the capacitive finger 14 presently selected by the controlled multiplexers 29 and 30 under control of the microprocessor 31. Otherwise, if the voltage level of the rectified filtered signal is below the reference voltage, this indicates that none of the sliders 4–7 is positioned over the presently selected capacitive finger 19 or 23. Hence, the microprocessor 31 scans and selects the fingers 19 or 23 in order, by controlling the multiplexers 29 and 30 while sampling the output of the detector 38. The capacitive fingers 19 and 23 are preferably sequentially scanned by the microprocessor 31, while sampling the detector 38 for the presence of the detection signal which when present indicates that the presently selected finger 19 and 23 corresponds to the position of a coupling element 4*a*–7*a*, and hence indicates the measuring positions of one of the sliders 4–7.

The preferred implementation chosen for the slider position detection is a row of printed circuit board fingers 19 and 23 arranged along the edge of the printed circuit board behind a rails 17 and 21 also on the printed circuit board. A simple metal plate, conductive plastic or bar can be used as the capacitive elements 4*a*–7*a* as part of the sliders 4–7 to cover one of the fingers 19 and 23 and the rails 17 and 21 for each slider 4–7. The capacitive coupling technique using rails 17 and 21, fingers 19 and 23 and elements 4*a*–7*a*, provide for an incremental scale for incrementally sensing the measuring positions of the sliders 4–7. However, other sensing implementations could may be used.

For example, a contact shorting technique would use slider elements that actually short the rails 17 and 21 to the fingers 19 and 23. However, contact slider elements may be subject to poor reliability. The capacitive element technique is preferred because the elements 4*a*–7*a* do not actually touch the fingers 19 and 23 and rails 17 and 21, and thereby provide some protection against dirt and moisture, which might otherwise cause failure when using contact shorting fingers, not shown, over a long period of time. Dirt, dust and moisture typically do not affect pure capacitive signal couplings. Hence, the capacitive coupling sliders 4–7 need only come relative close to the printed circuit board for the capacitive coupling action of the sliders 4–7 to couple enough energy from the sensing signal to one of the fingers 19 and 23 for the filter 36 and detector 38 to detect the presence of the sensing signal through capacitive coupling of the sliders elements 4*a*–7*a*. This is preferable because there are no electrical connections or contacts between the slider 4–7 and the fingers 19 and 23 on the printed circuit board, not shown.

For another example, a potentiometer implementation uses a linear potentiometer where the resistance of each slider is fed to an analog to digital converter, the digitized value of which is fed to the microprocessor 31 which then computes the position from the digitized value. This implementation is prone to some drift with time and wear and may not maintain the required accuracy over the ambient and power variations expected.

For another example, an ultrasonic implementation could employ ultrasonic enclosed ranging to measure the distance of the sliders where the sliders each have a reflector on the sliders. An ultrasonic pulse is produced by an ultrasonic transducer at one end of the apparatus where a receiving transducer measures the time for the pulse to proceed to the slider reflector and return. This time is fed to the microprocessor 31 where the distance is computed. This implementation is more expensive and complicated because of the cost of the transducers, suffers from potential dirt and moisture contamination and is more complex.

For another example, an LED implementation uses a series of infra red or visible light emitting diodes providing incremental light beam for sensing by a light receiver on the sliders 4–7. The microprocessor 31 then sequentially lights the LEDs in order. During a sequence of LED illuminations, the slider measuring position is determined when the microprocessor 31 receives an output from the light receiver mounted on each slider 4–7.

The preferred capacitive coupling implementation provides for static measurement where the sliders 4–7 are simply positioned and then a start button 8–11 is pressed to take the measurement. The above implementations allow for the static measurement of the position of the sliders, meaning that the sliders can be positioned, then the foot size is determined. However, dynamic measurements can be used where the distance that the slider travels from a home position to the measuring position is counted. A number of dynamic measurement techniques are available for measuring the distance traveled by the sliders 4–7. An incrementally interrupted light source and receiver arrangement can be used as a dynamic measurement technique. Also, a Hall Effect device operating against a linear rubber magnet so that the distance can be measured by counting the number of magnetic north south transitions detected. Both of these dynamic measurement techniques use substantially the same counting principle. However, two separate channels are required for the respective vertical and horizontal direction of travel of the sliders 5–7 and 4. While the sliders 4–7 must start from a home position, any subsequent motion direction changes can be determined by the microprocessor 31 as might typically occur as the sliders 4–7 are positioned near the final measuring positions. The use of a dynamic measurement technique will require the operator to take special care to start the sliders 4–7 from a specific start home location and then slide the sliders 4–7 to the measuring positions. Dynamic measurement methods typically have lower costs with increased operator burdens.

The microprocessor 31 typically includes RAM and or ROM memory, not shown, necessary for storing programs, table and data, as is well known. Here, the microprocessor 31 is particularly programmed to control the multiplexer 29 and 30 to scan the fingers 19 and 23 for the detection of slider measuring positions. After positioning the sliders 4–7 to the correct measuring positions, the operator presses a start button 8–11 which then invokes microprocessor 31 operation. The microprocessor 31 may first reset the displays and then start scanning for the measuring positions of the sliders 4–7. The displays 12 and 13 can be so controlled that the displays 12 and 13 preferably present readouts facing away from the human being measured and towards the operator, or visa-versa. For example and for operator convenience, the displays 12 and 13 are preferably be presented towards right heel and towards the operator when measuring the left foot, but would be presented upside down in reference to the human being measured.

The microprocessor 31 is programmed to scan and sense the buttons 8–11 and switches 14 and 15. The microprocessor 31 controls slider sensing and foot size computations when one of the start switches 8–11 is pressed. The microprocessor 31 may be turned off by a power switch, not shown, or a time out after computation and display of the foot size. The microprocessor 31 is activated when one of the start switches 8–11 is pressed. Preferably, the start switches 8–11 activate power to the apparatus 1 and supplies necessary power for a period of time necessary for the microprocessor programs to automatically sense switch positions, sense slider positions, compute the foot sizes, and display the results for a predetermined period of time. When the microprocessor 31 turns on, a conventional may reset occur and then the microprocessor 31 proceeds to control the multiplexers 29 and 30 to sequentially scan each of the capacitive fingers 19 and 23. The output of the detector 38 is sampled and when active indicates that the selected finger indicate a slider measuring position of one of the sliders 4–7. The microprocessor 31 stores finger positions in the microprocessor 31 for each of sliders 4–7 during multiplexer scanning. The microprocessor 31 also samples the selector switches 14 and 15 to determine the positions of the switches 14 and 15, and hence, the type of the human being measure and the country shoe size standard used. The foot size is dependent upon switch 14 indicating if a man, woman or child scale is to be used, and dependent upon switch 15 indicating the selected the country shoe size standards. After storing the measuring positions of the sliders 4–7 and the switch settings of switches 14 and 15, the shoe size will be computed and then displayed in the displays 12 and 13 based upon the switch positions of the switches 14 and 15 measuring positions of the sliders 4–7.

The use of the row configuration of the fingers 19 and 23, provides for a direct linear correlation and conversion from the detected fingers to a width or length linear measuring positions which can be normalized using a shoe size conversion scale selected by the type of human and country shoe size standard. The microprocessor 31 normalizes the measuring positions of the sliders 4–7 to present displays in the correct numerical format for the country selected.

The output displayed on displays 12 or 13 can represent either the toe length size of the foot as typically used for shoe size which is the longest dimension of the toe length of the foot or the ball length of the foot, by pressing a toe start button 8 or 10, respectively, or just the ball length of the ball of the foot to the heel, also referred to as the arch length, by pressing a start switch 9 or 11. In either case, the width will be determined based on whether start switch 8 or 10 is pressed or start switch 9 or 11 is pressed if there are differences between the two readings.

The microprocessor 31 may compute shoes size using mathematical normalization, but simple inexpensive ROM based look up tables may be used as well. For example, a shoe size look up table can be generated for each possible scale defined by selected man, woman or child human type and by the selected country size standard used. One of the look up tables would be selected depending upon the positions of the switches 14 and 15. The selected look up table could be organized to have a toe length column of toe lengths sizes, a ball length column of ball lengths sizes, and a width matrix of width sizes. The toe length column includes toe length sizes addressed by finger addresses indicated by one of the toe sliders 6 or 7. The ball length column of ball length sizes is addressed by finger addresses indicated by the ball slider 5. The width matrix is organized through width finger addresses by foot lengths. The width size is a function of width of the foot and the length of the foot, and hence a two-dimensional width matrix by is needed. The look up table includes the toe length column, ball length column and width matrix for each combination of man, woman, child and country standard.

When a toe start buttons 8 or 10 is pressed, the microprocessor 31 accesses the toe length and ball length columns by finger address and determines which is greater, the toe length or ball length. When the toe length is used, the microprocessor 31 addresses the toe length column by the toe length finger addresses to read and display on toe length on the length display 12. The toe length finger address points to a respective a row of width sizes in the width matrix, one of which is addressed by the width fingers 23 for reading the width size to be displayed on display 13. When the ball length is used to determine the foot size, the microprocessor 31 addresses the ball length column by the ball finger addresses to read and display on ball length on the length display 12 and the ball length finger address points to a respective a row of width sizes in the width matrix, one of which is addressed by the width fingers 23 for reading the width size to be displayed on display 13. These look up tables can be conveniently stored in ROM, not shown, of microprocessor 31.

The present invention preferably provides three vertically aligned sliders, the right toe slider, left toe slider and ball slider. However, when a foot is being measured only one of the toe sliders is used for the respective foot. Hence, the invention may equivalently include only two vertically aligned sliders, one of which is designated a toe slider and the other of which is designated a ball slider depending on which foot is being measured. The microprocessor 31 would detect during scanning a first measuring position and a second measuring position along the vertically extending fingers 19. By virtue of which start buttons 8–11 is pressed indicating which foot is being measured, the microprocessor 31 determines that the first and second measuring position is either the toe slider measuring position and ball slider position for one foot being measured, respectively, or ball slider measuring position and toe slider position, respectively, for the other foot being measured. In this manner, only two vertical slider are needed to determine the toe and ball measuring positions.

The apparatus includes electronic means for measuring the size of a human foot by electronic sensing of slider measuring positions and by determining of the correct shoe size of the foot from the measuring positions. Those skilled in the art may make improvements and modifications to the present inventions, but those improvements and modifications may nonetheless fall within the spirit and scope of the following claims.

What is claimed is:

1. An apparatus for measuring the foot size of a foot of a human, the apparatus comprising, cup means for receiving a heel of the foot and for positioning the foot in a stable position, toe slider means for slidably having toe slider positions including a toe slider measuring position at a tip of a furthest extending toe of the foot, the foot extends from the heel in the heel cup towards the tip of the furthest extending toe, ball slider means for slidably having ball slider positions including a ball slider measuring position at a ball on a ball side of the foot, width slider means for slidably having width slider positions including a width slider measuring position at a width side of the foot when the width slider buttresses the width side of the foot opposing the ball side of the foot, the width slider opposes the ball slider between which is disposed the foot, sensing means connected to the toe slider means, ball slider means and width slider means for sensing the toe slider positions, ball slider positions, and width slider positions, the sensing means provides the toe slider measuring position, ball slider measuring position and width slider measuring position corresponding to the positions of the toe, ball and width sliders, respectively, and determining means connected to the sensing means and for receiving the toe slider measuring position, ball slider measuring position, and width slider measuring position and for determining the size of the foot.

2. The apparatus of claim 1 wherein, the ball slider and toe slider are vertically aligned along the ball side of the foot, and the sensing means comprises a vertically extending row of sensing fingers vertically aligned to the ball slider and the toe slider for sensing the ball slider positions and toe slider positions.

3. The apparatus of claim 1 wherein the sensing means comprises, generator means for providing a sensing signal, a plurality of fingers means aligned with the toe slider, ball slider and width slider for indicating the toe slider measuring position, ball slider measuring position and width slider measuring position, toe element means connected to the toe slider means for coupling the sensing signal onto one of the finger means indicating the toe slider measuring position, ball element means connected to the ball slider means for coupling the sensing signal onto one of the finger means indicating the ball slider measuring position, width element connected to the width slider means for coupling the sensing signal onto one of the finger means indicating the width slider measuring position, scanning means for selecting the plurality of fingers in order, each selected finger means provides the sensing signal when one of the toe element, ball element or width element couples the sensing signal onto the selected finger means, and detection means for detecting the sensing signal when provided by the selected finger means indicating the toe slider measuring position, ball slider measuring position or width measuring position.

4. The apparatus of claim 1 wherein the apparatus further comprises, human type selection means for indicating if the human is a man, woman or child, and country standard selection means for indicating the country standard, the determination means determines the foot size based upon the human type and country standard indications, and the toe slider measuring position, ball slider measuring position or width measuring position.

5. The apparatus of claim 1 further comprises, width display means controlled by the determining means for displaying the determined width of the foot, and length display means controlled by the determining means for displaying the determined length of the foot, and start activation means for activating the sensing means for sensing the toe measuring position, ball slider measuring position and the width slider measuring position and for activating the determining means for determining and displaying the determined foot size.

6. The apparatus of claim 1 wherein, the ball slider comprises a curved surface for buttressing against the ball of the ball side of the foot for positioning the ball slider at the ball slider measuring position, and the width slider comprises a flat surface for buttressing against the width side of the foot for positioning the width slider at the width measuring position.

7. The apparatus of claim 1 further comprises, a vertical guide on which slides the toe slider and ball slider and under which is aligned a first portion of the sensing means for sensing the toe slider positions and ball slider positions.

8. The apparatus of claim 7 further comprises, a horizontal guide on which slides the width slider and under which is aligned a second portion of the sensing means for sensing the width slider positions.

9. An apparatus for measuring the foot size of a left foot or right foot of a human, the apparatus comprising, right heel cup means for receiving a right heel of the right foot and positioning the right foot in a stable position when measuring the right foot, left heel cup means for receiving a left heel of the left foot and positioning the left foot in a stable position when measuring the left foot, the left heel cup opposes the right heel cup inbetween which is disposed the left foot or right foot being measured, left toe slider means slidably having left toe slider positions including a left toe slider measuring position at a tip of a furthest extending toe of the left foot, the left foot extends from the left heel cup towards the right heel cup when the left foot is being measured, left toe slider element means connected to the left toe slider for sensing left toe slider measuring position when measuring the left foot, right toe slider means slidably having right toe slider positions including a right toe slider measuring position at a tip of a furthest extending toe of the right foot, the right foot extends from the right heel cup to towards the left heel cup when the right foot is being measured, right toe slider element means connected to the right toe slider element for sensing the right toe slider measuring position when measuring the right foot, ball slider means slidably having ball slider positions including a ball slider measuring position at a ball on a ball side of the left foot when being measured or the right foot when being measured, ball slider element means connected to the ball slider for sensing the ball slider measuring position when measuring either foot, width slider means slidably having width slider positions including the width slider measuring position at a width side of the left foot when being measured or the right foot when being measured when the width slider buttresses the width side opposing the ball side of the foot, the width slider opposes the ball slider between which is disposed either the left foot when being measured or the right foot when being measured, width slider element means connected to the width slider for sensing the width slider measuring position when measuring either foot, sensing means coupled to the left toe slider means, right toe slider means, ball slider means and width slider means for sensing and providing the left toe slider measuring position, the right toe measuring position, the ball slider measuring position, and the width slider measuring position, respectively, when measuring one of the left or right foot, and determining means connected to the sensing means and receiving a toe slider measuring position, ball slider measuring position, and width slider measuring position and determining the size of the left or right foot being measured, the toe slider measuring position is the right toe slider measuring position when measuring the right foot using the right toe slider or is the left toe slider measuring position when measuring the left foot using the left toe slider.

10. The apparatus of claim 9 wherein, the ball slider, left toe slider and right toe slider are vertically aligned along the ball side of the left or right foot being measured, and the sensing means comprises a vertically extending fingers aligned to the ball slider, the left toe slider and the right toe slider for sensing the ball slider positions, left toe slider positions and right toe slider positions.

11. The apparatus of claim 9 wherein the sensing means comprises, generator for providing a sensing signal, a plurality of fingers aligned with the left toe slider element, right toe slider element, ball slider element and width slider element and for respectively providing the left toe slider measuring position, the right toe slider measuring position, the ball slider measuring position and the width slider measuring position, the left toe slider element is for coupling the sensing signal onto a first one of the fingers indicating the left toe slider measuring position, the right toe slider element is for coupling the sensing signal onto a second one of the fingers indicating the right toe slider measuring position, the ball slider element is for coupling the sensing signal onto a third one of the fingers indicating the ball slider measuring position, and the width slider element is for coupling the sensing signal onto a fourth one of the fingers indicating the left toe slider measuring position, and multiplexer means for scanning the plurality of fingers in order to select the first, second, third and fourth fingers, the selected first, second, third and fourth fingers provide the sensing signal when the left toe slider element, right toe slider element, ball slider element or width slider element respectively couples the sensing signal onto the selected first, second, third and fourth fingers, and detection means for detecting the sensing signal when provided by the selected first, second, third and fourth fingers indicating the left toe slider measuring position, right toe slider measuring position, ball slider measuring position and width measuring positions.

12. The apparatus of claim 9 wherein, the determining means is a programmed microprocessor storing look up tables for cross referencing the left toe slider measuring position, right toe slider measuring position, ball slider measuring position and width measuring position to shoe sizes.

13. The apparatus of claim 9 further comprises, human type selection means for indicating if the human is a man, woman or child, country standard selection means for indicating the country standard, the determination means determines the foot size based upon the human type and country standard indications and based upon the left toe slider measuring position, right toe slider measuring position, ball slider measuring position and width measuring position, width display means controlled by the determining means for displaying the width of the foot, and length display means controlled by the determining means for displaying the length of the foot, and start activation means for activating sensing of the left toe, right toe, ball and width slider measuring positions and for activating the determining means to determine and display the foot size.

14. The apparatus of claim 9 wherein, the ball slider comprises a curved surface for buttressing against the ball of the ball side of the foot for positioning the ball slider at the ball slider measuring position, and the width slider comprises a flat surface for buttressing against the side of the width side of the foot for positioning the width slider at the width slider measuring position, the right toe slider is rigidly connected to left heel cup for buttressing the tip of the further extending toe of the right foot for positioning the right toe slider at the right toe measuring position when measuring the right foot, and the left toe slider is rigidly connected to right heel cup for buttressing the tip of the further extending toe of the left foot for positioning the left toe slider at the left toe measuring position when measuring the left foot.

15. The apparatus of claim 7 further comprises, a vertical guide aligned along the ball side of the left or right foot being measured and on which slides the left toe slider, right toe slider and ball slider and under which is aligned a first portion of the sensing means for sensing the left toe slider measuring position, right toe slider measuring position and ball slider measuring position, and a horizontal guide horizontally aligned towards the width side of the left or right foot being measured and on which slides the width slider and under which is aligned a second portion of the sensing means for sensing the width slider measuring position.

* * * * *